US011095969B2

(12) United States Patent
Min

(10) Patent No.: US 11,095,969 B2
(45) Date of Patent: Aug. 17, 2021

(54) EARPHONE INCLUDING INTERNAL DUCT

(71) Applicant: ALMUS Corp., Chungcheongnam-do (KR)

(72) Inventor: Byung Il Min, Gyeonggi-do (KR)

(73) Assignee: ALMUS Corp., Chungcheongnam-Do (KR)

( * ) Notice: Subject to any disclaimer, the term of this patent is extended or adjusted under 35 U.S.C. 154(b) by 0 days.

(21) Appl. No.: 16/922,034

(22) Filed: Jul. 7, 2020

(65) Prior Publication Data

US 2021/0021921 A1 Jan. 21, 2021

(30) Foreign Application Priority Data

Jul. 19, 2019 (KR) ..... 10-2019-0087439

(51) Int. Cl.

| | |
|---|---|
| ***H04R 1/10*** | (2006.01) |
| ***H04R 1/28*** | (2006.01) |
| ***H04R 3/00*** | (2006.01) |
| ***H04R 9/02*** | (2006.01) |
| ***H04R 9/04*** | (2006.01) |
| ***H04R 9/06*** | (2006.01) |

(52) U.S. Cl.

CPC ..... *H04R 1/1016* (2013.01); *H04R 1/1075* (2013.01); *H04R 1/28* (2013.01); *H04R 3/002* (2013.01); *H04R 9/025* (2013.01); *H04R 9/046* (2013.01); *H04R 9/06* (2013.01); *H04R 2400/11* (2013.01); *H04R 2460/11* (2013.01)

(58) Field of Classification Search

None

See application file for complete search history.

(56) References Cited

U.S. PATENT DOCUMENTS

| | | | | |
|---|---|---|---|---|
| 6,738,487 | B1 * | 5/2004 | Nageno | H04R 1/1016 381/322 |
| 10,924,839 | B2 * | 2/2021 | Jou | H04R 1/04 |
| 2012/0070022 | A1 * | 3/2012 | Saiki | H04R 9/063 381/312 |
| 2012/0201406 | A1 * | 8/2012 | Yamaguchi | H04R 1/1016 381/309 |
| 2014/0348372 | A1 * | 11/2014 | Seo | H04R 1/1016 381/380 |

FOREIGN PATENT DOCUMENTS

| | | | |
|---|---|---|---|
| KR | 10-1558091 | B1 | 10/2015 |
| KR | 10-1738523 | B1 | 5/2017 |
| KR | 10-2017-0098527 | A | 8/2017 |
| KR | 10-1952909 | B1 | 5/2019 |

* cited by examiner

*Primary Examiner* — Walter F Briney, III

(74) *Attorney, Agent, or Firm* — Harness, Dickey & Pierce, P.L.C.

(57) ABSTRACT

Disclosed is an earphone including an internal duct. The earphone includes a housing, a cover coupled to the housing and including a nozzle, and a speaker unit disposed in the cover. Here, the housing and the cover include, in common, a first space portion disposed in front of the speaker unit and a second space portion disposed in the rear of the speaker unit and partitioned from the first space portion. The speaker unit includes a yoke, a magnet fixed to the yoke, a plate disposed on a top surface of the magnet, a voice coil, a diaphragm disposed above the plate and to which the voice coil is fixed, a frame disposed outside the magnet, a first grill coupled to the frame and disposed above the diaphragm, and a second grill coupled to the frame and disposed on a front surface of the diaphragm and outside the frame.

8 Claims, 9 Drawing Sheets

EARPHONE INCLUDING INTERNAL DUCT

CROSS-REFERENCE TO RELATED APPLICATION

This application claims priority to and the benefit of Korean Patent Application No. 10-2019-0087439, filed on Jul. 19, 2019, the disclosure of which is incorporated herein by reference in its entirety.

FIELD

An embodiment relates to an earphone including a duct therein.

BACKGROUND

An earphone includes a speaker unit which generates a sound wave in a housing. Also, the earphone includes a cover including a nozzle to which an eartip is coupled. The cover is coupled to the housing. Korean Patent Publication No. 10-2017-0098527 (published on Aug. 30, 2017, hereinafter, referred to as the document) discloses an earphone including a nozzle. In the document, a front housing including the nozzle is coupled to a rear housing including a speaker unit.

Meanwhile, in the document, a tuning groove configured to change a tone may be provided in a cover portion corresponding to the front housing including the nozzle. Some of sound waves generated by the speaker unit are discharged into the tuning groove such that a tone or sound feature of a sound output through the nozzle may be changed. The tuning groove is disposed in a front surface of the cover portion and exposed. Accordingly, there is a problem that water or foreign substances flow into the housing of the earphone through the tuning groove. Also, there is a problem that external noise causes a loss of sound of the earphone.

RELATED ART DOCUMENT

Patent Document

Korean Patent Publication No. 10-2017-0098527 (published on Aug. 30, 2017)

SUMMARY

The present invention is directed to providing an earphone capable of relieving a phenomenon that fatigue of tympanum of a listener becomes severe or an ear is deafened due to a difference between atmospheric pressures inside and outside the earphone as well as preventing water or foreign substances from flowing into a housing of the earphone while changing a tone.

The present invention is also directed to providing an earphone capable of fundamentally excluding acoustic interference from external noise.

Aspects of the present invention are not limited to the above-stated aspects and other unstated aspects of the present invention will be understood by those skilled in the art from the following description.

According to an embodiment of the present invention, there is provided an earphone including an internal duct. The earphone includes a housing, a cover coupled to the housing and including a nozzle, and a speaker unit disposed in the cover. Here, the housing and the cover include, in common, a first space portion disposed in front of the speaker unit and a second space portion disposed in the rear of the speaker unit and partitioned from the first space portion. The speaker unit includes a yoke having a cylindrical shape with an open top, a magnet fixed to the yoke, a plate disposed on a top surface of the magnet, a voice coil disposed between an outer circumference of the yoke, an inner circumference of the magnet, and an inner circumference of the plate, a diaphragm disposed above the plate and to which the voice coil is fixed, a frame disposed outside the magnet, a first grill coupled to the frame and disposed above the diaphragm, and a second grill coupled to the frame and disposed on a front surface of the diaphragm and outside the frame. The first grill includes a tuning hole and a tuning portion configured to cover the tuning hole. The earphone includes a duct formed of a space between an inner wall of the second grill and an outer wall of the frame. The duct and the tuning hole allow the first space portion and the second space portion to communicate with each other.

The frame may include a groove, and the groove may be concavely formed in an outer surface of the frame and disposed to be connected from a top end to a bottom end of the frame.

The earphone may further include a fixing ring connected to the diaphragm. Here, the fixing ring may be coupled to the frame. The fixing ring may be an annular member and include a cut portion having a shape with a partially cut outer circumferential surface. Also, the cut portion may be disposed to be aligned with the groove.

The first grill may include an accommodation groove concavely formed in a top surface to form a space in which the tuning portion is mounted, and the tuning hole may be disposed in the tuning portion.

The first grill may include a flange disposed along an outer circumference. Here, the flange may include a slot concavely disposed toward a center of the first grill, and the slot may be disposed to be aligned with the groove.

The earphone may further include a fixing ring connected to the diaphragm. Here, the fixing ring may be coupled to the frame. The fixing ring may be an annular member and include a cut portion having a shape with a partially cut outer circumferential surface. Also, the cut portion and the slot may be disposed to be aligned with each other.

The first grill may include a first hole. Here, the second grill may include a second hole. The first hole and the second hole may be disposed to be aligned with each other. Also, a diameter of the second hole may be at least greater than a diameter of the first hole.

The speaker unit may further include a damper, and the damper may be disposed on a top surface of the second grill and come into contact with an inner surface of the cover.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

The aspects, particular advantages, and novel features of the present invention will become apparent from the following detailed description of exemplary embodiments with reference to the attached drawings. Also, the terms used in the specification and the claims should not be limited to general or lexical meanings and should be construed as meanings and concepts coinciding with the technical concept of the present invention on the basis of a principle in which the inventor can appropriately define the concept of the terms to describe the invention in the best manner. Also, in describing the present invention, a detailed description of well-known functions or components of the related art will be omitted when it is deemed to obscure the essence of the present invention.

Hereinafter, an earphone according to an embodiment will be described in detail with reference to the attached drawings.

Figure 1:
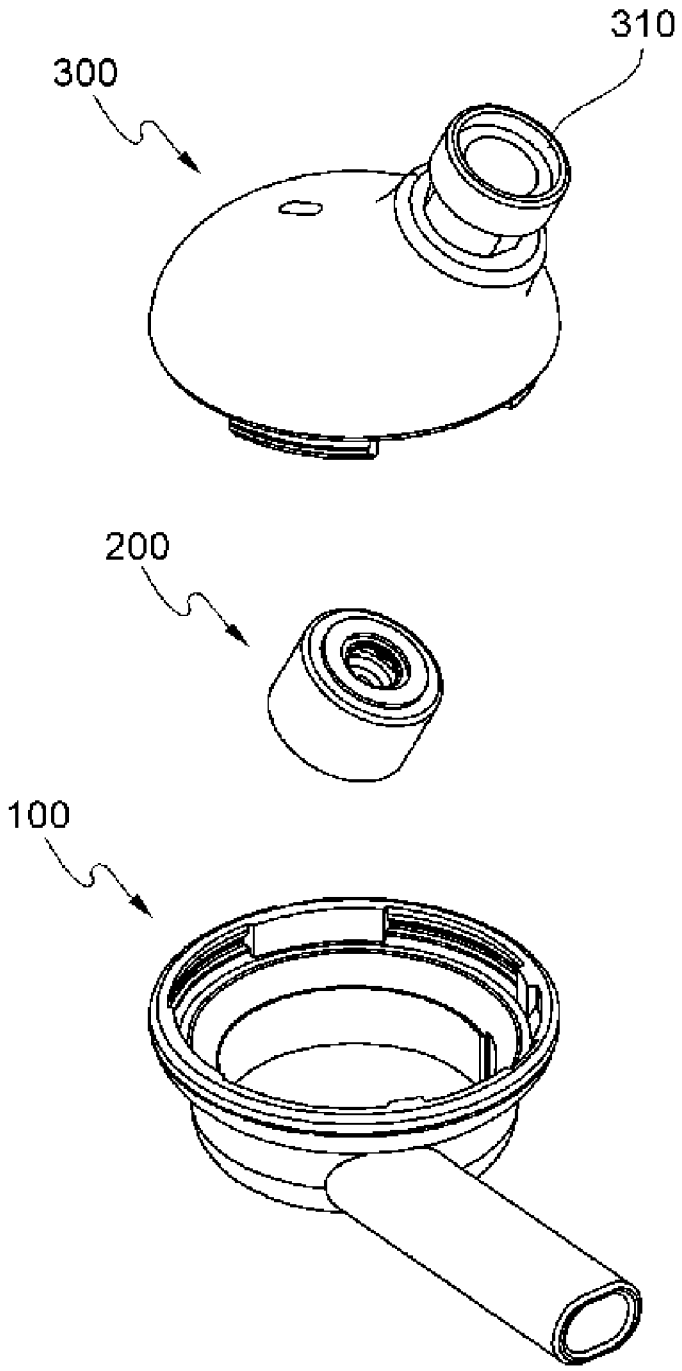
FIG. 1 is an exploded view of an earphone according to an embodiment.
Figure 2:
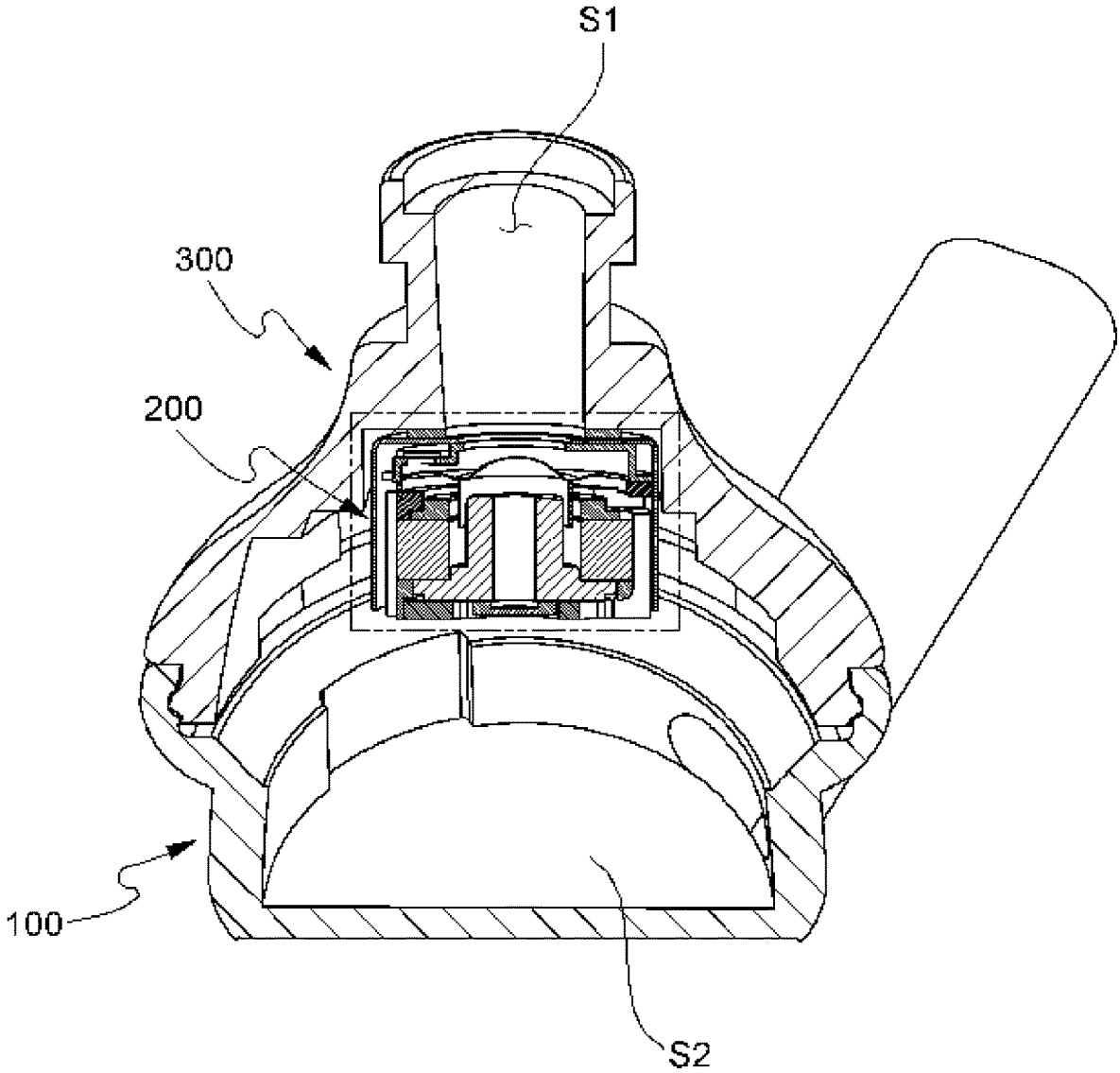
FIG. 2 is a side cross-sectional view of the earphone shown in FIG. 1.

FIG. 1 is an exploded view of the earphone according to the embodiment, and FIG. 2 is a side cross-sectional view of the earphone shown in FIG. 1.

Referring to FIGS. 1 to 2, the earphone according to the embodiment includes a housing 100, a speaker unit 200, and a cover 300. Hereinafter, the terms such as a front side and a front surface include a meaning of indicating a direction of facing the cover 300 on the basis of the speaker unit 200, and the term such as a rear side indicates a direction of facing the housing 100 on the basis of the speaker unit 200.

The cover 300 accommodates the speaker unit 200 therein. A cable is led into the housing 100. The led cable is connected to the speaker unit 200. On the whole, the housing 100 may be a cylindrical member with an open front. The cover 300 may be coupled to the front of the housing 100. The front of the housing 100 has an annular shape.

The speaker unit 200 converts an electrical signal into a sound wave which is an audio signal.

The cover 300 is coupled to the housing 100. The cover 300 covers the housing 100 which is opened. The cover 300 includes a nozzle 310. The nozzle 310 is a place to which an eartip is coupled.

While the speaker unit 200 is accommodated in the cover 300, an inner space of the housing 100 and the cover 300 is divided into a first space portion 51 and a second space portion S2 by the speaker unit 200.

Referring to FIG. 2, the first space portion 51 means a space disposed in front of the speaker unit 200. In detail, the first space portion 51 means a space surrounded by inner surfaces of the speaker unit 200 and the cover 300 while the speaker unit 200 is accommodated in the cover 300. The first space portion 51 communicates with the nozzle 310 (refer to FIG. 1).

The second space portion S2 means a space disposed in the rear of the speaker unit 200. In detail, the first space portion 51 means a space surrounded by inner surfaces of the speaker unit 200, the housing 100, and the cover 300 while the speaker unit 200 is accommodated in the cover 300. A sound wave generated by the speaker unit 200 is transferred to the first space portion 51.

Figure 3:
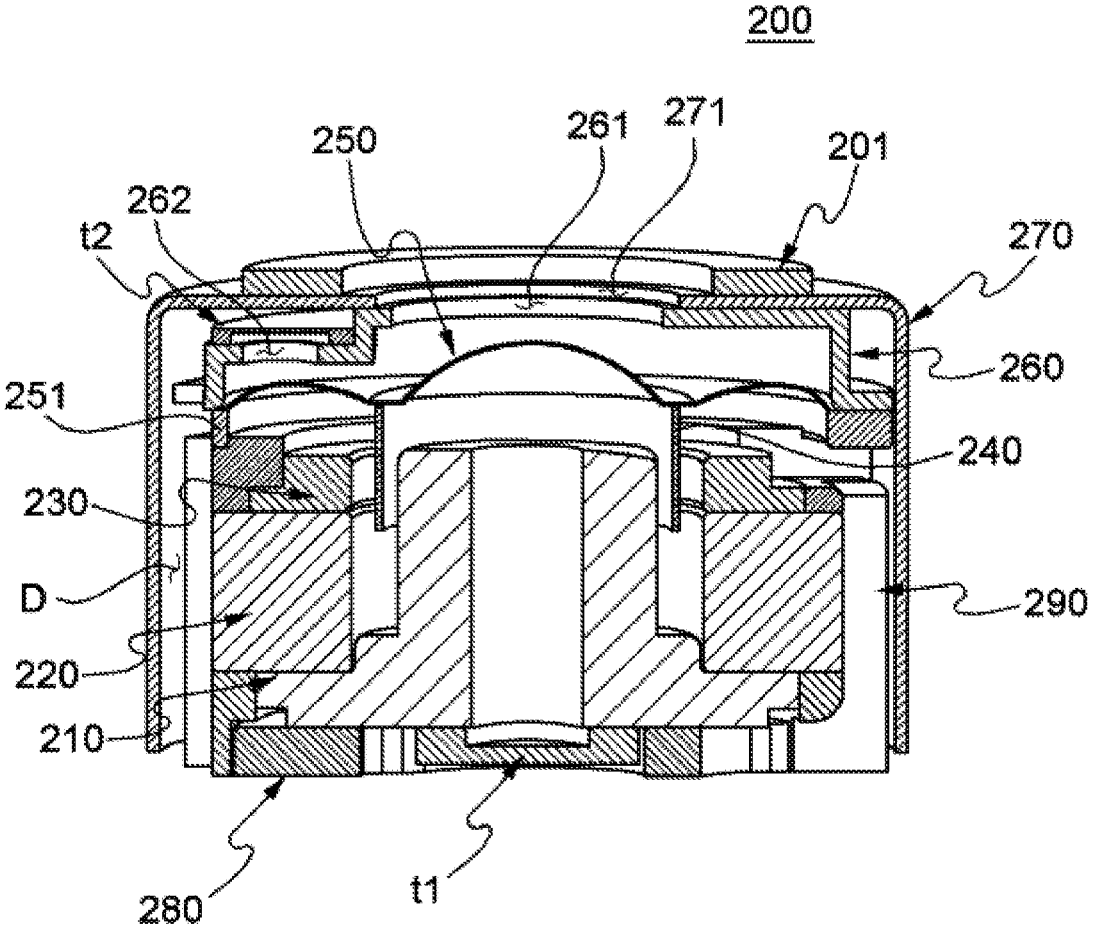
FIG. 3 is a side cross-sectional view illustrating a speaker unit of the earphone shown in FIG. 1.

FIG. 3 is a side cross-sectional view illustrating the speaker unit of the earphone shown in FIG. 1.

Referring to FIG. 3, the speaker unit 200 includes a yoke 210.

The yoke 210 performs a function of forming a magnetic circuit and fixes a magnet 220. An inlet of a central hole of the yoke 210 may be covered with a tuning material t1.

The speaker unit 200 includes the magnet 220. The magnet 220 may be accommodated outside the yoke 210. The magnet 220 may have an annular shape.

The speaker unit 200 includes a plate 230. The plate 230 may be an annular member. The plate 230 may be disposed on a top surface of the magnet 220.

The speaker unit 200 includes a voice coil 240. The voice coil 240 is fixed to a diaphragm 250 such that a part of a lower side is disposed between an outer circumference of the yoke 210 and an inner circumference of the magnet 220.

The speaker unit 200 includes the diaphragm 250. An outer circumference of the diaphragm 250 is fixed to a fixing ring 251. The fixing ring 251 is coupled to a top surface of a frame 290.

The speaker unit 200 includes a first grill 260. The first grill 260 covers an open top of the frame 290. The first grill 260 comes into contact with a top surface of the fixing ring 251.

The speaker unit 200 includes a second grill 270. The second grill 270 is disposed outside the first grill 260. Also, the second grill 270 is disposed outside the frame 290. The second grill 270 covers the first grill 260.

A substrate 280 is coupled to a bottom surface of the yoke 210, receives an electrical signal from the outside, and transmits the electrical signal to the voice coil 240.

The frame 290 is coupled to the yoke 210. The frame 290 may be an annular-shaped member including an inner circumferential surface and an outer circumferential surface.

A damper 201 is disposed on a top surface of the second grill 270. The damper 201 comes into contact with an inner wall of the cover 300.

A magnetic field moves toward a space between the plate 230 and the yoke 210. When a current is applied to the voice coil 240 such that the voice coil 240 is magnetized, the voice coil 240 moves according to a magnetic polarity of the voice coil 240. That is, when the polarity of the voice coil 240 is equal to polarities of the plate 230 and the yoke 210, the voice coil 240 is pushed and moved. When the polarity of the voice coil 240 differs from the polarities of the plate 230 and the yoke 210, the voice coil 240 is pulled and moved. As described above, when the voice coil 240 moves, the diaphragm 250 generates a sound by vibrating air while moving back and forth.

Figure 4:
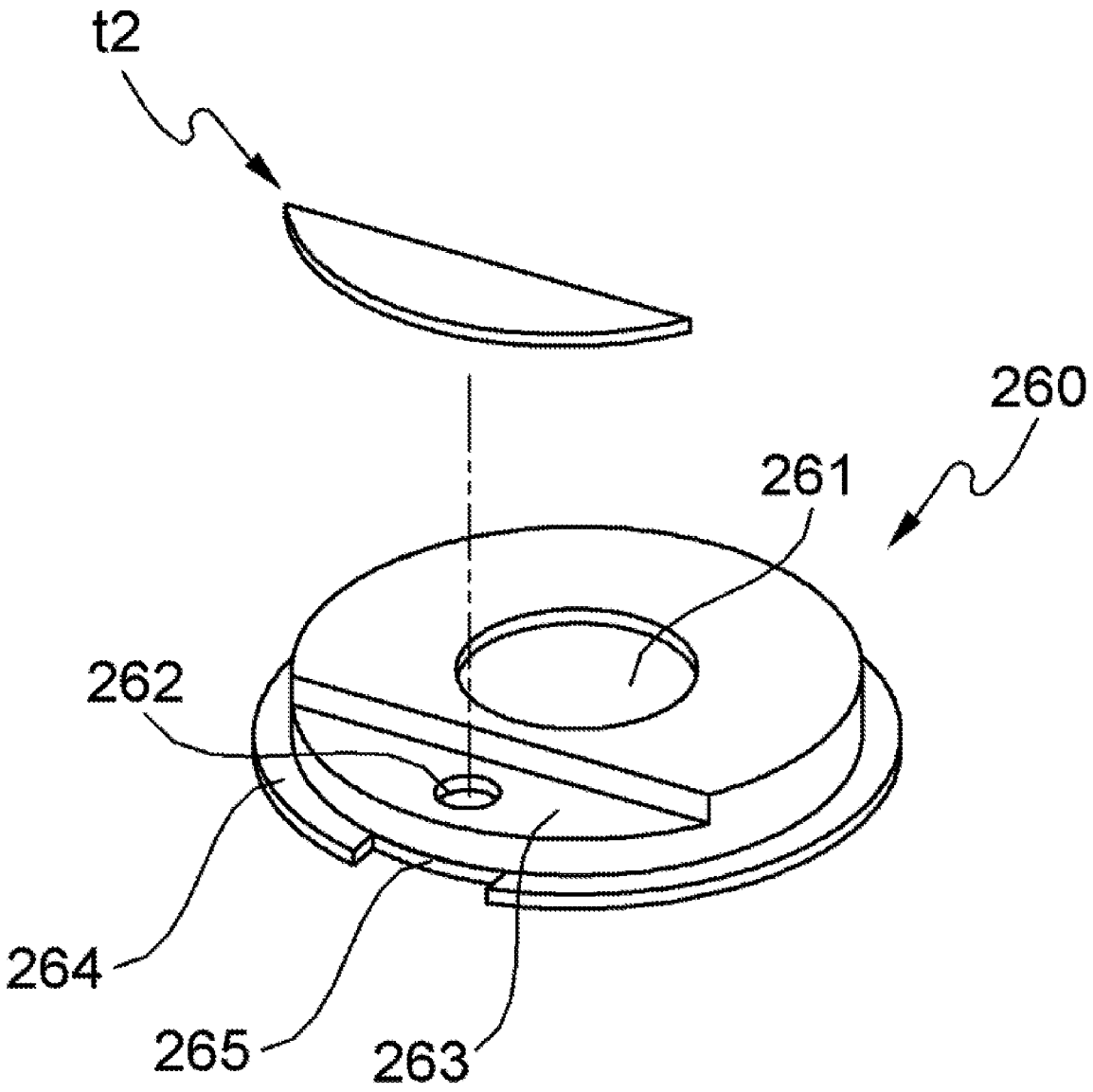
FIG. 4 is a view illustrating a first grill and a tuning portion.

FIG. 4 is a view illustrating the first grill and a tuning portion.

Referring to FIG. 4, the first grill 260 generally has a hat shape. A first hole 261 may be disposed at a center of the first grill 260. Also, the first grill 260 may include an accommodation groove 263. The accommodation groove 263 is concavely formed on a top surface of the first grill 260 and forms a space in which a tuning portion t2 is mounted. The tuning portion t2 is mounted in the accommodation groove 263. A shape of the accommodation groove 263 may correspond to a shape of the tuning portion t2.

The first grill 260 includes a tuning hole 262. The tuning hole 262 is disposed while passing through the top surface and a bottom surface of the first grill 260. The tuning hole 262 may be disposed in the accommodation groove 263. The tuning portion t2 is disposed in the accommodation groove 263 to cover the tuning hole 262. A shape of the tuning hole 262 may be a circular shape as shown in the drawing but is not limited thereto and may be an oblong shape, an elliptical shape, or the like.

A tone or an acoustic feature of a sound which passes through the tuning portion t2 via the tuning hole 262 is changed. The tuning portion t2 may be a mesh material and may include polyester, nylon, nonwoven fabric, a membrane filter, and the like.

The first grill 260 may include a flange 264. The flange 264 may be disposed to be stepped along an outer circumference of the top surface of the first grill 260. The flange 264 comes into contact with the top surface of the fixing ring 251.

The first grill 260 may include a slot 265. The slot 265 may be implemented to have shape formed by partially cutting the flange 264. The slot 265 has a structure for allowing an upper space of the first grill 260 to communicate with a duct D.

Figure 5:
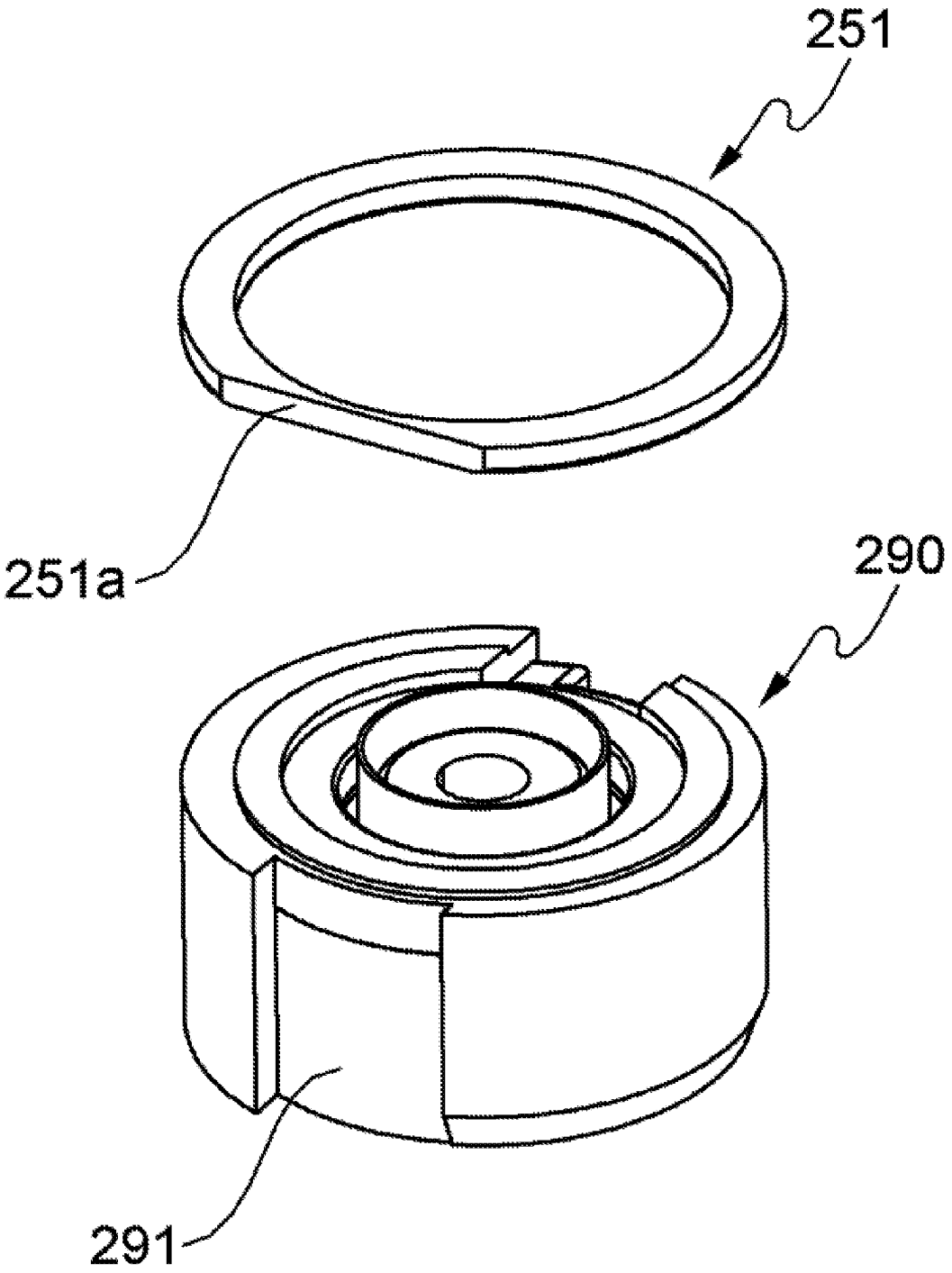
FIG. 5 is a view illustrating a frame and a fixing ring.
Figure 6:
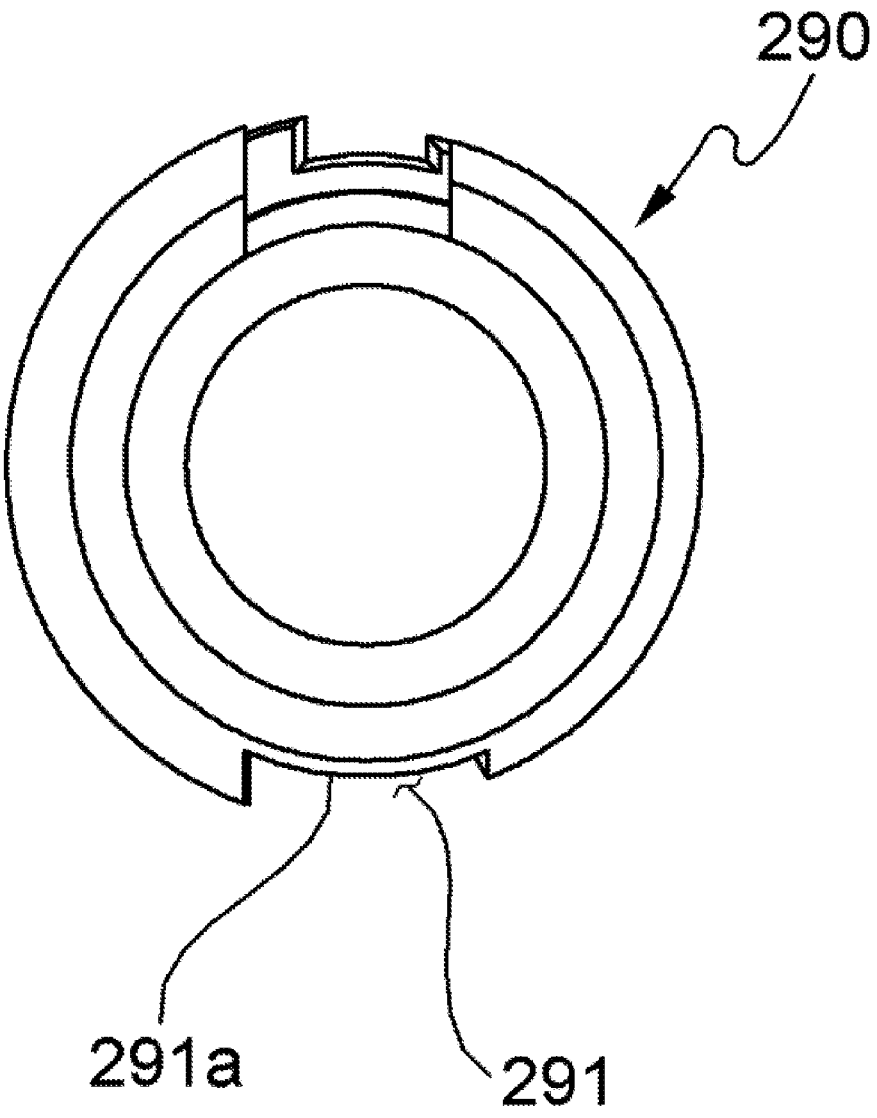
FIG. 6 is a plane view illustrating the frame.

FIG. 5 is a view illustrating the frame and the fixing ring 251, and FIG. 6 is a plan view of the frame.

Referring to FIG. 5, the fixing ring 251 is disposed above the frame 290. The fixing ring 251 may include a cut portion 251*a*. The cut portion 251*a* may have a shape formed by cutting one part of an outer circumference of the fixing ring 251. The cut portion 251*a* secures a space for allowing the upper space of the first grill 260 to communicate with the duct D.

The frame 290 may include a groove 291. The groove 291 is configured to secure a space of the duct D. The groove 291 is concavely disposed on an outer circumferential surface of the frame 290. The groove 291 may be formed to be connected from a top surface to a bottom surface of the frame 290. The groove 291 may be formed to have a certain width in a circumferential direction of an outer circumference of the frame 290.

Figure 7:
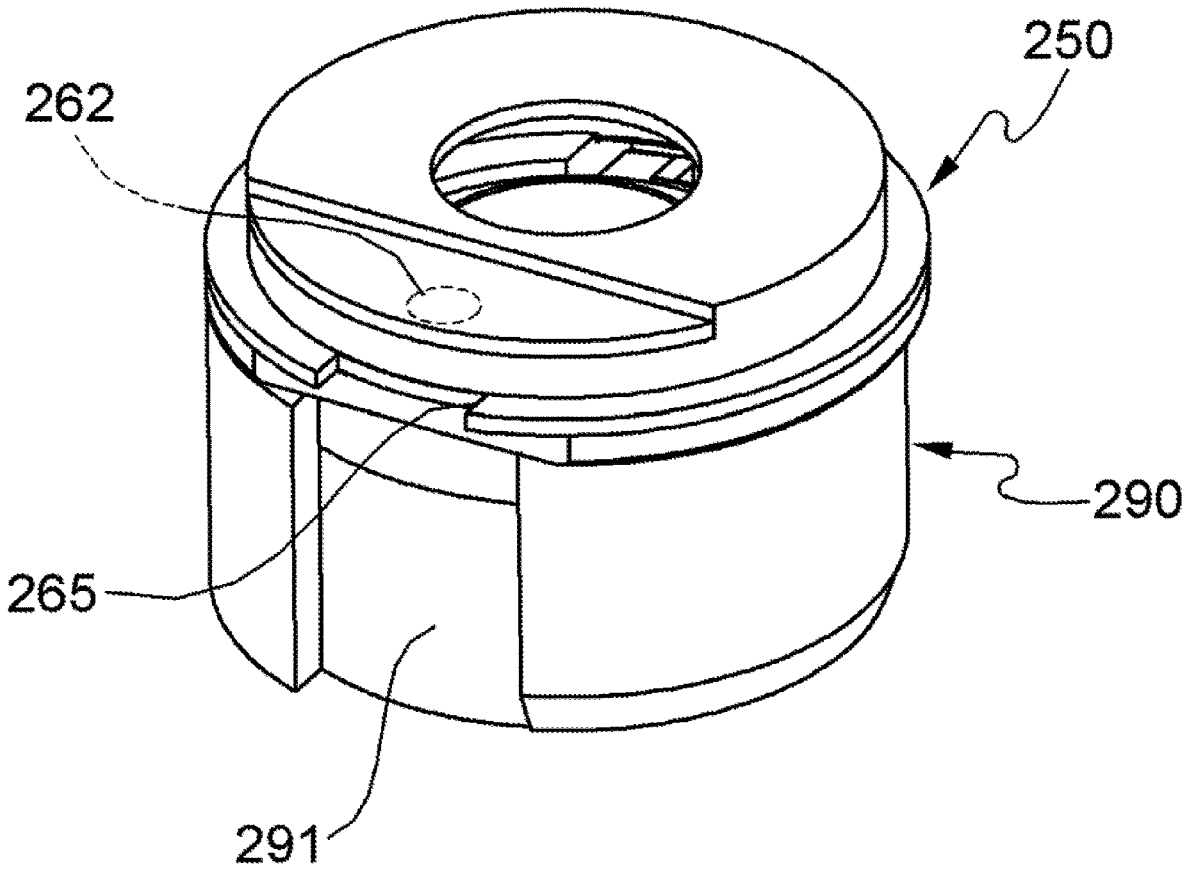
FIG. 7 is a view illustrating a state in which the first grill is mounted on the frame.

FIG. 7 is a view illustrating a state in which the first grill is mounted on the frame.

Referring to FIGS. 5 to 7, the first grill 260 is disposed on the frame 290. The cut portion 251*a* is aligned with the groove 291 of the frame 290. A slot 265 of the first grill 260 is also aligned with the groove 291 of the frame 290. This is a configuration for allowing the tuning hole 262 and the duct D to effectively communicate with each other.

Referring to FIG. 6, a bottom surface of the groove 291 of the frame 290 may be a curved surface 291*a*. A center of curvature of the curved surface 291*a* may be equal to a center of the cylindrical frame 290. A curvature radius of the curved surface 291*a* may be at least greater than an outer radius of the magnet 220.

Figure 8:
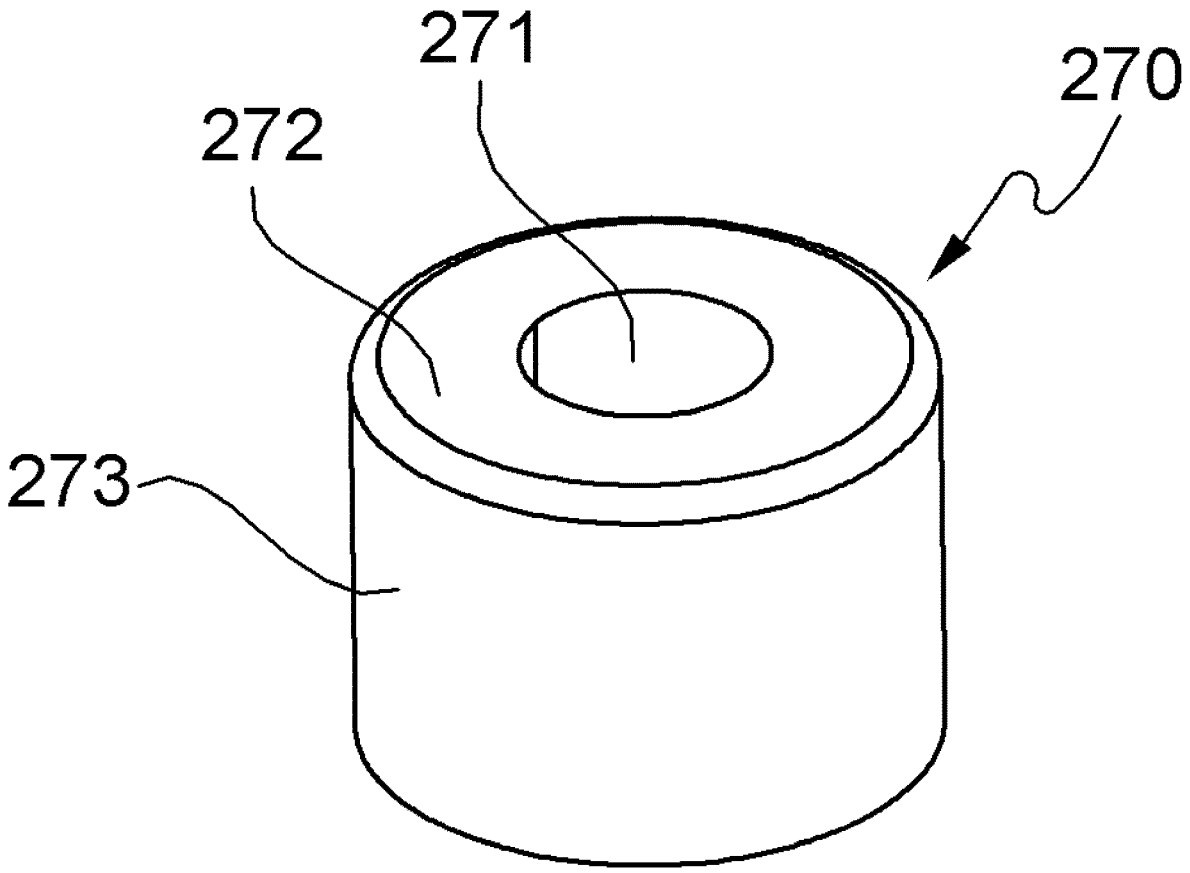
FIG. 8 is a view illustrating a second grill.

FIG. 8 is a view illustrating the second grill.

Referring to FIG. 8, the second grill 270 is disposed to cover the first grill 260 and the frame 290. The second grill 270 may be a cylindrical member with an open bottom. The second grill 270 may include a top part 272 and a side part 273. A second hole 271 may be disposed in the top part 272. When the second grill 270 is disposed outside the first grill 260, the second hole 271 is aligned with the first hole 261. An inner diameter of the side part 273 of the second grill 270 may be at least greater than an outermost diameter of the first grill 260. The inner diameter of the side part 273 of the second grill 270 may be greater than an outer diameter of the frame 290. On the basis of a back-and-forth direction, a top surface of the tuning portion t2 disposed on the first grill 260 and an inner wall of the second grill 270 may be arranged to be spaced apart.

Figure 9:
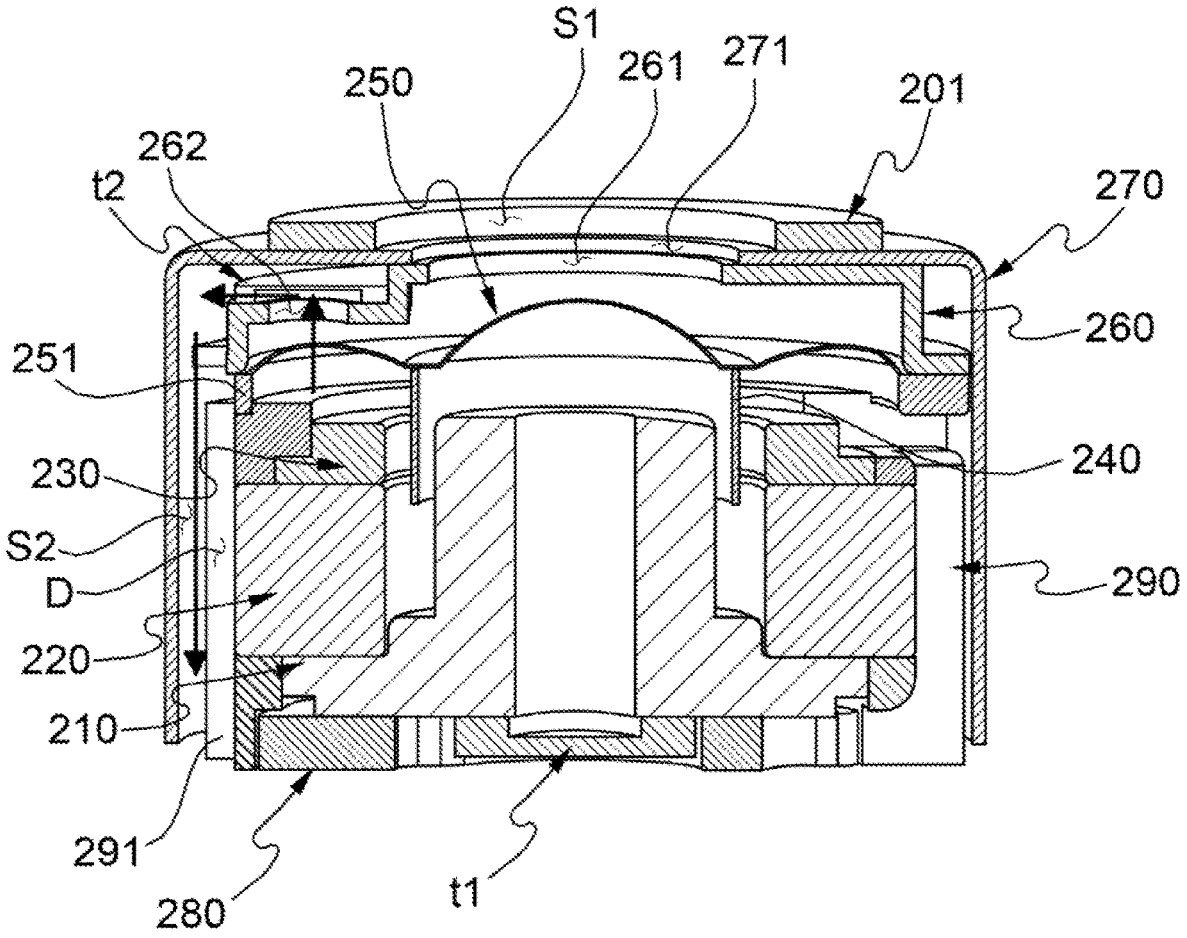
FIG. 9 is a view illustrating airflow through a duct.

FIG. 9 is a view illustrating airflow through the duct.

Referring to FIG. 9, the speaker unit 200 includes the duct D.

The duct D is defined as a space between the inner wall of the second grill 270 and the groove 291 of the frame 290. The duct D allows the first space portion 51 located in front of the diaphragm 250 and the second space portion S2. The front of the diaphragm 250 may communicate with the second space portion S2 through the duct D.

A part of sound generated by movement of the diaphragm 250 passes through the tuning hole 262. The sound which has passed through the tuning hole 262 passes through the tuning portion t2. The sound which passes through the tuning portion t2 flows into a space between an outer surface of the first grill 260 and an inner surface of the second grill 270. During this process, the sound is tuned.

The sound, which has passed through the tuning portion t2, is transferred to the second space portion S2 through the duct D. Here, there is no hole, which communicates with the outside, in the cover 300 and the housing 100. Accordingly, a space formed by the housing 100 and the cover 300 is in a sealed state such that external noise may be blocked and a loss of sound may be minimized. Also, since a hole is not present in a surface of the earphone, there is provided an advantage of well sustaining an external shock. Also, due to high hermeticity, it is possible to prevent foreign substances or water from flowing into the earphone.

Although the space formed by the housing 100 and the cover 300 is in the sealed state, air in the first space portion 51 is transferred to the second space portion S2 through the tuning hole 262 and the duct D. Accordingly, a phenomenon that fatigue of tympanum of a listener becomes severe or an ear of a listener is deafened, which may occur due to a difference between atmospheric pressures inside and outside the earphone caused by the sealed space, is relieved.

According to the embodiment, since a duct is formed between a second grill and a frame of a speaker unit to adjust airflows in a front space and a rear space of the speaker unit, there is provided an advantageous effect of fundamentally eliminating an exposed tuning hole.

According to the embodiment, there is provided an advantageous effect of preventing water or foreign substances from flowing into a housing of an earphone.

According to the embodiment, there is provided an advantageous effect of minutely adjusting a sound by replacing speaker units having different sized ducts.

According to the embodiment, since there is no hole in a surface of the earphone, there is an advantage of well sustaining an external shock.

According to the embodiment, there is provided an advantageous effect of relieving a phenomenon that fatigue of tympanum of a listener becomes severe or an ear is deafened due to a difference between atmospheric pressures inside and outside the earphone.

As described above, the earphone which includes an internal duct according to one exemplary embodiment of the present invention has been described in detail.

It should be noted that the above-described one embodiment of the present invention is merely an example in all aspects and not intended to be limitative, and the scope of the present invention will be defined by the following claims rather than the above detailed description. Also, it should be construed that all changeable or modifiable shapes derived from the meaning and scope of the claims and equivalents thereof are included in the scope of the present invention.

What is claimed is:

1. An earphone including an internal duct, the earphone comprising:

a housing;

a cover coupled to the housing and comprising a nozzle; and a speaker unit disposed in the cover, wherein the housing and the cover comprise, in common:

a first space portion disposed in front of the speaker unit; and a second space portion disposed in the rear of the speaker unit and partitioned from the first space portion, wherein the speaker unit comprises:

a yoke having a cylindrical shape with an open top;

a magnet fixed to the yoke;

a plate disposed on a top surface of the magnet;

a voice coil disposed between an outer circumference of the yoke, an inner circumference of the magnet, and an inner circumference of the plate;

a diaphragm disposed above the plate and to which the voice coil is fixed;

a frame disposed outside the magnet;

a first grill coupled to the frame and disposed above the diaphragm; and a second grill coupled to the frame and disposed on a front surface of the diaphragm and outside the frame, wherein the first grill comprises a tuning hole and a tuning portion configured to cover the tuning hole, wherein the earphone comprises a duct formed of a space between an inner wall of the second grill and an outer wall of the frame, and wherein the duct and the tuning hole allow the first space portion and the second space portion to communicate with each other.

2. The earphone of claim 1, wherein the frame comprises a groove, and wherein the groove is concavely formed in an outer surface of the frame and disposed to be connected from a top end to a bottom end of the frame.

3. The earphone of claim 2, further comprising a fixing ring connected to the diaphragm, wherein the fixing ring is coupled to the frame, wherein the fixing ring is an annular member and comprises a cut portion having a shape with a partially cut outer circumferential surface, and wherein the cut portion is disposed to be aligned with the groove.

4. The earphone of claim 2, wherein the first grill comprises an accommodation groove concavely formed in a top surface to form a space in which the tuning portion is mounted, and wherein the tuning hole is disposed in the tuning portion.

5. The earphone of claim 2, wherein the first grill comprises a flange disposed along an outer circumference, wherein the flange comprises a slot concavely disposed toward a center of the first grill, and wherein the slot is disposed to be aligned with the groove.

6. The earphone of claim 5, further comprising a fixing ring connected to the diaphragm, wherein the fixing ring is coupled to the frame, wherein the fixing ring is an annular member and comprises a cut portion having a shape with a partially cut outer circumferential surface, and wherein the cut portion and the slot are disposed to be aligned with each other.

7. The earphone of claim 2, wherein the first grill comprises a first hole;

wherein the second grill comprises a second hole, wherein the first hole and the second hole are disposed to be aligned with each other, and wherein a diameter of the second hole is at least greater than a diameter of the first hole.

8. The earphone of claim 1, wherein the speaker unit comprises a damper, and wherein the damper is disposed on a top surface of the second grill and comes into contact with an inner surface of the cover.

* * * * *